United States Patent [19]

White

[11] Patent Number: 4,477,079

[45] Date of Patent: Oct. 16, 1984

[54] GOLF SWING TRAINING AND PRACTICE DEVICE

[76] Inventor: Arthur A. White, P.O. Box 10396, Santa Ana, Calif. 92711

[21] Appl. No.: 408,300

[22] Filed: Aug. 16, 1982

[51] Int. Cl.[3] ..... A63B 69/36

[52] U.S. Cl. ..... 273/186 R; 324/160

[58] Field of Search ..... 273/186 R, 186 A; 364/410; 73/379; 324/160, 180

[56] References Cited

U.S. PATENT DOCUMENTS

| | | | |
|---|---|---|---|
| 2,933,681 | 4/1960 | Crain | 273/186 R X |
| 3,091,466 | 5/1963 | Speiser | 273/185 R |
| 3,194,563 | 7/1965 | Mackniesh | 273/186 R |
| 3,776,555 | 12/1973 | Hagaman | 273/186 R |
| 3,801,108 | 4/1974 | Murray | 273/186 R |
| 4,254,956 | 3/1981 | Rusnak | 273/186 R |
| 4,306,722 | 12/1981 | Rusnak | 273/186 R |

*Primary Examiner*—George J. Marlo

*Attorney, Agent, or Firm*—Klein, Szekeres & Fischer

[57] ABSTRACT

A golf swing training and practice device by which a golfer may ascertain various characteristics, such as clubhead speed and elapsed swing time, regarding the swing of his golf club. The present training and practice device comprises a portable, battery or AC powered apparatus for accurately measuring, computing, and displaying both the elapsed time to complete the golfer's swing and the speed by which a golfer's clubhead is moved through a measuring zone. The measuring zone is established by the optical axes of a pair of photodetectors or the like, that are mounted within a detector head. Unlike conventional golf training or practice apparatus, the photodetectors of the present invention are responsive to ambient light. The photodetectors are disposed in parallel alignment with one another, so as to receive respective horizontal and parallel beams of light, whereby to define the measuring zone therebetween. The present device includes both a digital speed setting by which a golfer may set a target clubhead speed to achieve and a digital readout display for reporting the actual speed at which the clubhead is moved through the measuring zone. A pair of achievement lights provides the golfer with a momentary visual indication whether or not his actual clubhead speed has surpassed his desired or target clubhead speed. A printer may also be associated with the present device, so as to provide the golfer with a permanent indication of his clubhead speed and the elapsed time in which to complete his swing.

19 Claims, 7 Drawing Figures

GOLF SWING TRAINING AND PRACTICE DEVICE

BACKGROUND OF THE INVENTION

1. Field of the Invention

This invention relates to a relatively low cost, portable, and battery or AC powered golf training and practice device which can be used by a golfer of any ability in and out of doors for providing both a temporary and permanent record, whereby to accurately indicate certain characteristics of the golfer's swing, such as, for example, clubhead speed and elapsed swing time.

2. Prior Art

Golf training and practice apparatus are known in the prior art in which a golf club is moved past a series of sensing stations in order that a golfer may learn information regarding certain characteristics of his golf club swing. However, the conventional training or practice apparatus are undesirably characterized by several shortcomings. For example, many conventional apparatus have a relatively large size and require an interface with an alternating current power source, usually by means of a corresponding power cord. Therefore, such apparatus cannot be easily transported by car so as to be moved from place to place. Moreover, the use of such conventional apparatus is limited to locations where suitable power is available.

In conventional apparatus which include optical sensing stations, it is common to employ an overhead light source which is built into the apparatus housing so as to establish one or more vertically extending optical paths between companion transmitters and detectors. The beams are broken by the movement of a golf club therethrough. However, a cumbersome platform structure is typically required to secure the optical transmitters and detectors in spaced vertical alignment relative to one another. Such a structure is known to undesirably increase the cost and size of the apparatus.

The flexibility of conventional golf training or practice apparatus is also limited, inasmuch as there is generally no provision in the conventional apparatus for a remote optical detector assembly, whereby the sensing and computational stations can be separated from one another. Thus, the use of the conventional apparatus may not be practical for many different indoor and outdoor applications. What is more, the information that is supplied from conventional apparatus to a golfer is frequently limited in both content and format. That is, no golf training or practice apparatus is known which is adapted to provide a permanent record (e.g. a hard copy printout) of the golfer's performance, including the date of each practice swing. Moreover, conventional apparatus are usually incapable of accurately indicating, in miles per hour, the golfer's clubhead speed. What is more, conventional apparatus include no means by which the golfer may set a desired clubhead speed, so that his actual clubhead speed can be compared therewith. What is still more, no golf training or practice apparatus is known which is adapted to provide a visual indication by which the golfer may easily and quickly ascertain whether or not he has achieved the desired clubhead speed. What is even more, no golf training or practice apparatus is known which is adapted to provide an accurate measurement and visual indication by which a golfer may easily and quickly ascertain the total elapsed time to complete his golf club swing, from the start of a backswing until impact is made with a golf ball.

In addition to the foregoing, no golf training or practice apparatus is known which is adapted to be interfaced with a remote photo or video camera, so that the golfer's practice swing and swing characteristics can be recorded to permit the subsequent study and review thereof.

Examples of prior art golf training and practice apparatus which include one or more of the limitations described above may be found by referring to the following U.S. patents:

| | |
|---|---|
| 3,513,387 | May 19, 1970 |
| 3,601,408 | August 24, 1971 |
| 3,892,414 | July 1, 1975 |
| 3,992,012 | November 16, 1976 |
| 4,136,387 | January 23, 1979 |
| 4,180,270 | December 25, 1979 |

SUMMARY OF THE INVENTION

Accordingly, it is a principal object of the present invention to provide a relatively low cost, portable golf training and practice device which is adapted to provide a golfer with accurate information regarding certain characteristics of his golf club swing, such as clubhead speed and elapsed swing time.

It is an additional object of this invention that the present training and practice device be powered by either an alternating current or battery source of supply, whereby the device is adapted for operation both in or out of doors.

It is another object of this invention that the present training and practice device include associated printing means by which to provide the golfer with a permanent record of his performance, including the date of each practice swing.

It is yet another object of this invention that the present training and practice device include means by which to accurately compute and display, in miles per hour, the golfer's clubhead speed.

It is a further object of this present invention that the present training and practice device include means by which the golfer may set a desired clubhead speed, which speed he can attempt to achieve in one or more practice swings.

It is still a further object of this invention that the present training and practice device have means by which to both compare the clubhead speed set by the golfer with the actual clubhead speed achieved and to provide a momentary visual indication, whereby to permit the golfer to quickly and easily ascertain whether or not his actual clubhead speed has surpassed the desired clubhead speed.

It is yet a further object of this invention that the present training and practice device include means by which to accurately compute and display, in (hundredths of) seconds, the total elapsed time to complete the golfer's swing, from the start of the backswing to an impact with a golf ball.

It is an additional object of this invention that the present training and practice device include a detector block comprising at least a pair of photodetectors that are aligned relative to one another so as to be responsive to parallel beams of ambient light that are horizontally applied thereto.

It is another object of this invention that the present training and practice device be interfaced with a remote photo or video camera, so that the golfer's performance and swing characteristics (e.g. clubhead speed and swing time) can all be recorded for future review and study.

It is still another object of this invention that the present training and practice device have associated therewith an external detector head and digital display, whereby to permit the present device to be capable of remote operation.

These and other objects of the invention will be explained in detail hereinafter in the following specification and the claims which are appended thereto.

DESCRIPTION OF THE PREFERRED EMBODIMENT

Figure 1:
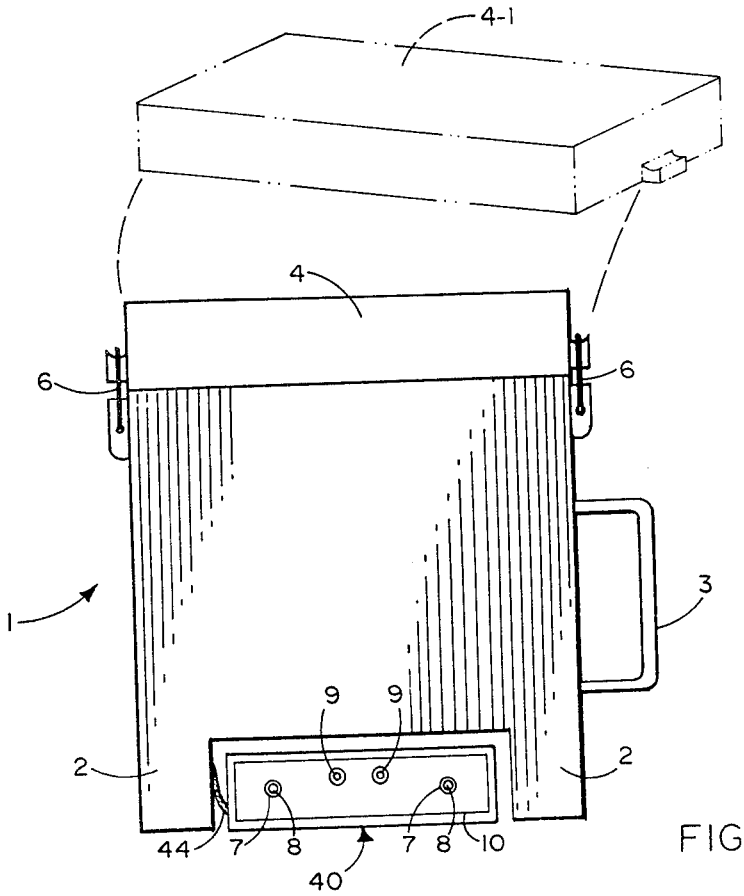
FIG. 1 shows the front of the carrying case of the portable golf training and practice device that forms the present invention.

The golf training and practice device which forms the present invention is best described while referring to the drawings. FIG. 1 of the drawings shows a case 1 by which to permit the hereinbelow disclosed device to be conveniently transported from place to place. The portable nature of the presently disclosed device is considered to be a particular advantage, inasmuch as, and unlike many conventional golf training or practice apparatus, the present device may be conveniently utilized both in and out of doors. The carrying case 1 includes two or more legs 2 and a handle 3 of any convenient configuration by which to permit the present training and practice apparatus to be easily transported. A top cover 4 is removably attached to the carrying case 1 by means of any suitable and well-known latch assembly 6. As will be described in greater detail in FIG. 2, the golfer may remove cover 4 (shown in phantom and represented by the reference numeral 4'), so as to expose the control panel of the present training and practice device.

A metal or plastic detector block 40 is suitably dimensioned so as to fit underneath carrying case 1 and between the legs 2 thereof, so as to minimize space consumption. Detector block 40 is electrically interconnected with carrying case 1 by means of a cable 44, or the like. A pair of apertures 7 are formed in the front of detector block 40, and a photodetector 8 is recessed within each aperture. By way of example, each photodetector 8 may comprise a commercially available phototransistor. In a preferred embodiment, the distance between the optical axes (best illustrated in FIGS. 3 and 4 of the drawings) of the photodetectors 8 is approximately 3.0 inches. As an important feature of the present invention and as will be described in greater detail hereinafter, photodetectors 8 are responsive to substantially parallel and horizontal beams of ambient light signals that are supplied thereto via respective apertures 7. A second pair of apertures are formed in the front of detector block 40. A different colored achievement light 9 is located within each of the aforementioned apertures. The purpose of achievement lights 9 will also be discussed in greater detail hereinafter. A transparent (e.g. plastic) plate 10 is positioned flush with the face of detector block 40, so as to cover the apertures 7 and photodetectors 8. The achievement lights 9 preferably extend through cover plate 10 so as to maximize the visibility thereof. Plastic plate 10 functions to prevent water, dirt and other undesirable contaminants from either blocking the apertures 7 or damaging the respective photodetectors 8 that are located therewithin.

Figure 2:
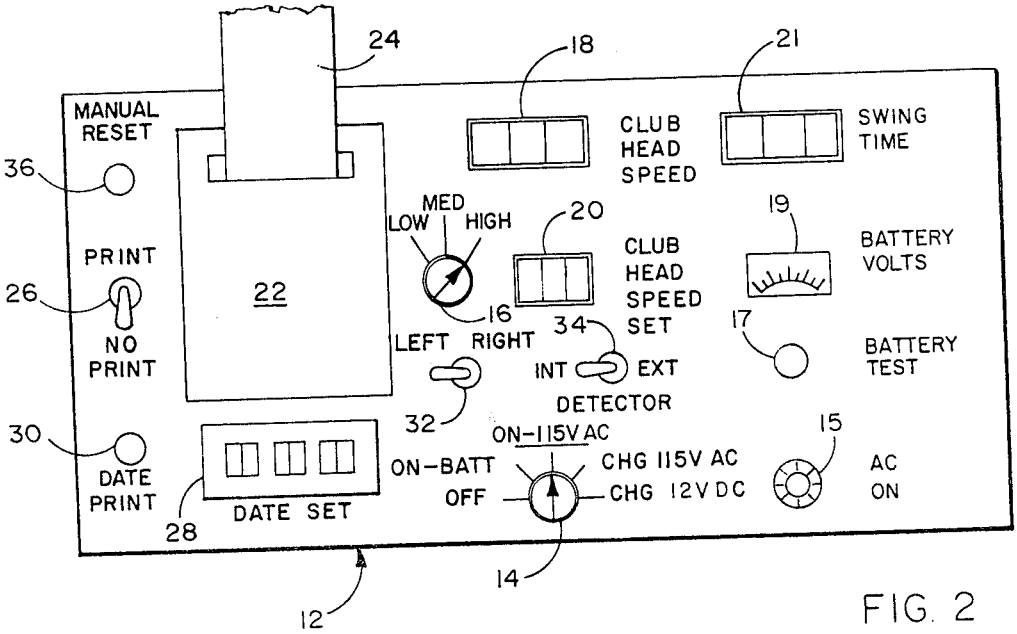
FIG. 2 is a top view of the carrying case of FIG. 1 with the cover thereof removed, whereby to expose a panel for controlling the operation of the present golf training and practice device.

FIG. 2 of the drawings shows the top of the present golf training and practice device with the cover thereof (designated 4 in FIG. 1) removed, so as to expose a control panel 12. Control panel 12 includes an on-off switch 14. Switch 14 may be rotated to a first position, whereby the present training or practice device is adapted to be powered from a self-contained battery source of supply. Battery power is desirable when the present training and practice device is to be used at a remote or outdoors location, such as for example, at the beach, on a lawn, at a driving range, or on a fairway. When a suitable alternating current power source (i.e. 115 volts AC) is available, switch 14 can be rotated to a second position to permit such use. Switch positions are also available to permit the self-contained batteries to be charged (from either of a 115 volts AC or a 12 volts DC electrical source). Accordingly, it is possible to charge the batteries of the present training and practice device from a conventional automobile battery.

An A.C. indicator lamp 15 is positioned at control panel 12. Indicator lamp 15 is illuminated whenever selector switch 14 is rotated to a position such that the present training and practice device is powered from an alternating current power source. Indicator lamp 15 is also illuminated when selector switch 14 is rotated to a position in which the batteries of the training and practice device are charged by means of the alternating current power source. Should it be necessary or advantageous to power the training and practice device from a self-contained battery source, it is desirable that the batteries be suitably charged. Therefore, panel 12 includes a battery test push-button switch 17 and a battery voltage indicating meter 19. Accordingly, the golfer may easily ascertain the available battery voltage by pressing push-button switch 17 and reading the meter 19.

Control panel 12 also includes a light intensity control switch 16, such as a potentiometer. As was previously disclosed, the photodetectors of the present training and practice device are responsive to ambient light signals. Therefore, light intensity control switch 16 can be rotated to any one of a plurality of positions, whereby to compensate for either particularly sunny days, for medium light intensity conditions, such as that occurring in the late afternoon, or for relatively low artificial lighting, such as that commonly encountered at an indoors location. Switch 16 functions to adjust the sensitivity of the photodetectors (designated 8 in FIG. 1), depending upon the intensity of the light that is available within the environment in which the present training and practice device is to be utilized. Thus, the present device can be used in both natural daylight or artificial indoor light, so as to benefit the golfer by providing him with greater flexibility whenever and wherever a practice session is contemplated.

The speed at which the golfer swings his golf club head through the measuring zone (as defined by the distance between the optical axes of photodetectors 8 in FIG. 1), is indicated, in miles per hour, at a digital display 18. Digital display 18 may be formed from a series of (e.g. three) digits that are each comprised of conventional light emitting diode segments, or the like. Frequently, however, a golfer wishes to achieve a particular clubhead speed. That is, in order to either increase or decrease the distance over which a golf ball can be driven, it may be necessary for a golfer to correspondingly adjust his clubhead speed. Therefore, control panel 12 also includes a means 20 by which the golfer may set a target clubhead speed, in miles per hour. By way of example, the clubhead speed set means 20 comprises a 3-wheel digital rotary thumbwheel switch.

As will be described in greater detail hereinafter, the desired clubhead speed (as established by set means 20) and the actual clubhead speed (as indicated by display 18) are compared with one another. The colored achievement lights (designated 9 in FIG. 1) are selectively illuminated, so as to provide the golfer with information regarding the actual speed of his golf club swing relative to the desired or target speed thereof. For example, a white achievement light might be illuminated if the golfer's actual clubhead speed is equal to or greater than his target clubhead speed. A red achievement light might otherwise be illuminated if the golfer's actual clubhead speed is less than his target clubhead speed. However, each achievement light is energized for a relatively short amount of time (e.g. approximately 0.5 seconds) so that the golfer receives a momentary indication of his clubhead speed. In a preferred embodiment of the invention, the achievement lights are located at detector block 40 (of FIG. 1), so that the golfer is required to keep his eyes on the ball or the representation thereof in order to observe the momentary indication being provided by the achievement lights. However, it is to be understood that the achievement lights could also be located at control panel 12.

Frequently, a golfer's performance may be improved or perfected by controlling the speed of his backswing. That is, it is often necessary for the golfer to coil up on his back-swing swing and not rush his downswing. Therefore, the total elapsed time expended by a golfer to complete his swing (i.e. from the start of a backswing until impact is made with a golf ball) is indicated, in seconds, at a digital display 21. Similar to digital display 18, display 21 may be formed from a series of (e.g. three) digits that are each comprised of conventional light emitting diode segments, or the like. Hence, and as will be disclosed in greater detail hereinafter, the golfer's swing time can be displayed in hundredths of a second. By virtue of the present invention, a golfer will be able to compare and correlate his swing time (at display 21) with his clubhead speed (at display 18).

In addition to a display of the golfer's clubhead speed and elapsed swing time, as provided by digital displays 18 and 21, control panel 12 also includes a printer 22. Therefore, and unlike golf training or practice apparatus of the prior art, the present device includes a pair of indicating means (i.e. 18 and 22) by which the golfer can obtain both a temporary and permanent record of his golf clubhead speed and swing time. Printer 22 may be any conventional printer, such as a thermal printer, or the like, that prints indicia, corresponding to the golfer's clubhead speed and swing time, on a paper tape 24. Accordingly, the golfer may tear off suitable portions of paper tape 24, so as to compile a history of his performances for future review. A toggle switch 26 is associated with printer 22 so as to control the activation thereof. In the event that the golfer is not desirous of obtaining a permanent record of his performance, he may deactivate printer 22 by moving switch 26 to an appropriate position. However, with toggle switch 26 positioned so as to deactivate printer 22, the golfer must rely on either of the digital displays 18 and 21 or the achievement lights (designated 9 in FIG. 1) in order to obtain an indication of his golf clubhead speed and swing time.

Also associated with printer 22 is a means by which the golfer may print the date (in addition to his clubhead speed and swing time) of each practice swing. More particularly, control panel 12 includes a 6-wheel digital rotary thumbwheel switch 28 which permits the golfer to set the month, day, and year of each practice swing. A push-button switch 30 is provided, so that the golfer can selectively activate printer 22 and thereby print on tape 24 the date which has been established at thumbwheel switch 28. Accordingly, the inclusion of thumbwheel switch 28 allows the golfer to compare his performance on a day-by-day basis, whereby the golfer will be able to study the various stages of improvement and attempt to maximize the consistency of his golf club swing.

Control panel 12 is also provided with a toggle switch 32 to adapt the present training and practice device to respond to the direction of the golfer's swing. Toggle switch 32 can be moved into one of two different positions, as determined by a left or right-handed swing of the golfer. As will be disclosed in greater detail, the position of toggle switch 32 acts to control the photodetectors (designated 8 in FIG. 1), so that the operating sequence thereof corresponds with the direction of the golfer's swing through the measuring zone.

In the embodiment illustrated in FIG. 1, photodetectors 8 are disposed in a detector block 40 which can be positioned beneath the carrying case 1 of the present golf training and practice device. However, and by way of an additional embodiment of the present invention, the instant training and practice device may also include an optional external or remote detector block (best illustrated in FIGS. 4 and 5), so as to permit the present training and practice device to be advantageously utilized when it is desirable to record the golfer's performance by means of a camera (e.g. designated 50 in FIG. 5). Accordingly, a toggle switch 34, or the like, is provided at control panel 12, which switch 34 may be moved to either one of two positions, so as to condition the training and practice device for either internal (as represented by the embodiment of FIG. 1) or remote (as characterized by FIGS. 4 and 5) detector operation.

A push-button reset switch 36 is also provided at control panel 12. By depressing switch 36, a golfer may manually reset the present training and practice device. That is, digital displays 18 and 21 are cleared and the photodetectors 8 are conditioned to respond to the subsequent movement of a golf club therepast.

Figure 3:
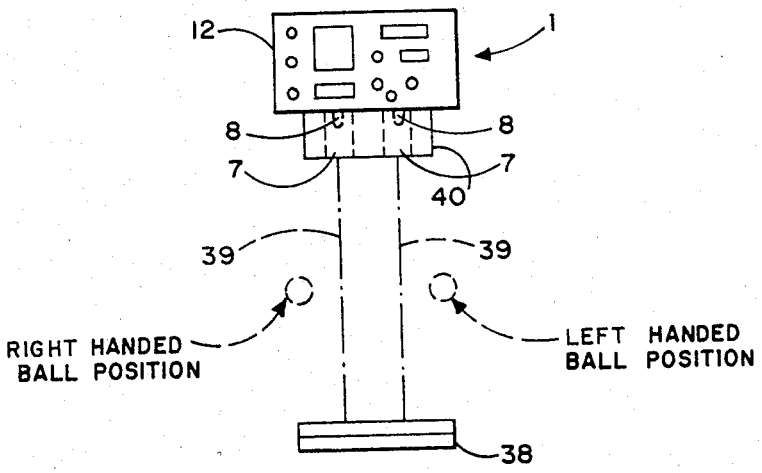
FIG. 3 illustrates the operation of the present golf training and practice device in a fixed or internal mode.

The operation of the present golf training and practice device is now described while referring concurrently to FIGS. 1–3 of the drawings. For example, when it is desirable to use the golf training and practice device within the confines of a building, where the level of ambient light is relatively low, the golfer initially rotates on-off switch 14 to a suitable ON position, which switch position is determined by the power supply (either AC or battery) to be utilized. The light intensity control switch 16 is rotated to a suitable position, so as to compensate for relatively low ambient light conditions. Thumbwheel switch 20 is set so as to establish a desired clubhead speed for the golfer to achieve. Toggle switch 26 is moved into a position so as to energize printer 22. The golfer may then set the present date by means of thumbwheel switch 28. Depressing push-button 30 causes the corresponding date to be printed on paper tape 24. Toggle switch 34 is moved to a position so as to energize the photodetectors 8 that are disposed within the detector block 40. Toggle switch 32 is moved to a suitable position to correspond with the direction of the golfer's swing.

As is best represented in FIG. 3, the golfer assumes an appropriate stance behind a light stabilizer block 38. Light stabilizer block 38, which preferably has the shape of a triangular bar, functions to prevent the photodetectors 8 from undesirably responding to spurious light signals that are emitted from a source thereof behind the golfer. More particularly, stabilizer block 38 is particularly aligned with detected block 40 so as to both block transmission of spurious light signals to photodetectors 8 and provide a reflective surface from which photodetectors 8 can be supplied with respective horizontal beams of light having substantially identical intensities.

In accordance with an important aspect of the present invention, the pair of photodetector apertures 7 are accurately drilled or bored in parallel alignment with one another into detector block 40, so that the diameters of apertures 7 are slightly larger than the corresponding diameters of the photodetectors 8 which are to be received therewithin. Moreover, to provide proper photodetector sensitivity, each aperture 7 is formed with a length that is at least 12 times longer than the diameter thereof. The aforementioned ratio between the length to diameter of aperture 7 ensures that photodetectors 8 are responsive to those light signals which are substantially parallel to the optical axes 39 thereof. Several advantages are derived by virtue of supplying photodetectors 8 with parallel and horizontal beams of light, rather than with vertical beams of light, as are typically supplied to training or practice apparatus of the prior art. More particularly, photodetectors 8 may be positioned at a location (i.e. under carrying case 1), so as to conserve space and to avoid interfering with the movement of the golfer. Moreover, by utilizing horizontal beams of light, photodetectors 8 will be responsive to any portion of the golfer's clubhead, including the hosel.

The distance between the optical axes 39 of photodetectors 8 defines the length of the measuring zone through which the golfer's clubhead is moved in order to provide an indication of clubhead speed. As previously disclosed, the length of the measuring zone is approximately 3.0 inches. Clubhead speed is determined after the golfer's club has passed through the measuring zone and broken the respective parallel and horizontal light beams that are supplied from light stabilizer block 38 to the photodetectors 8. In order to practice under realistic conditions, the golfer positions a golf or practice ball on a tee at a convenient location (designated left or right-handed ball position in FIG. 3) outside of the measuring zone and between light stabilizer block 38 and the detector head 40. Inasmuch as the present golf training and practice device is responsive to horizontal beams of light, the left and right-handed ball positions may be spaced (e.g. by up to approximately 2 feet) from photodetectors 8 without causing a loss of detector sensitivity. By placing a golf ball at either of the left or right-handed ball positions, the golfer can improve the habit of keeping his eye on the impact area throughout his swing. However, it is to be understood that an accurate indication of the golfer's clubhead speed and swing time can be provided whether or not a golf ball is actually used. Inasmuch as the golfer's clubhead speed is dependent upon a traversal of the measuring zone by the golfer's clubhead, either a plastic or sponge golf ball, or no golf ball at all, will suffice herein without diminishing the accuracy by which the golfer's clubhead speed and swing time are indicated at the control panel 12 of carrying case 1.

Figure 4:
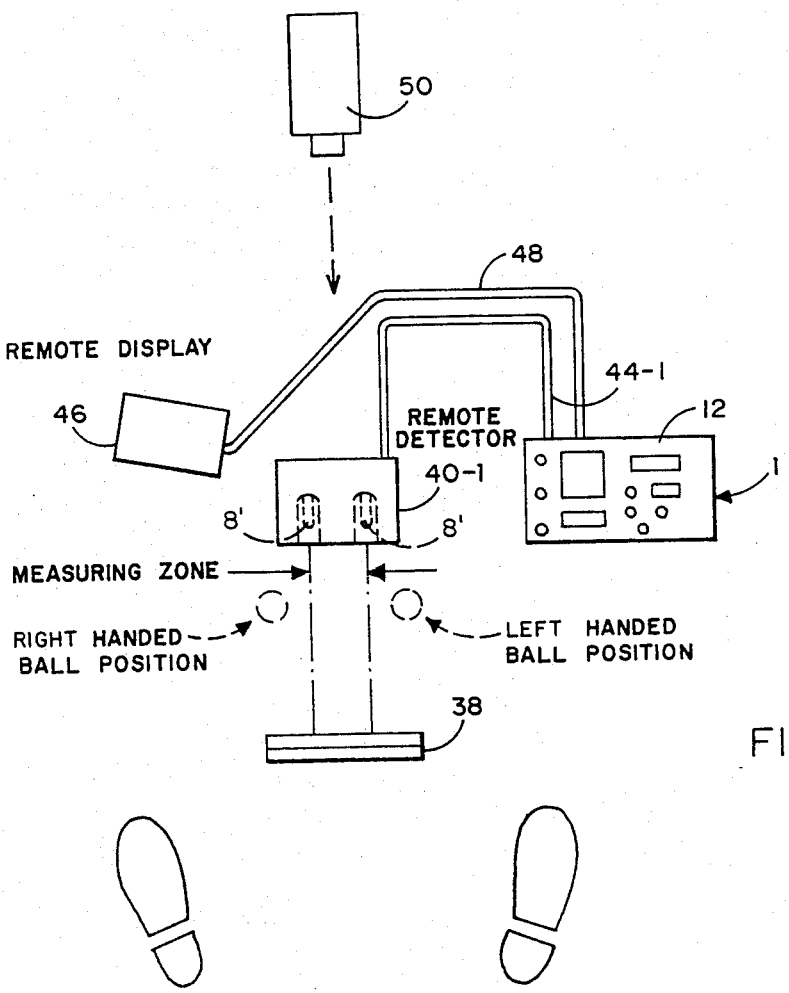
FIG. 4 shows a top view of the present golf training and practice device being utilized in a remote or external mode.
Figure 5:
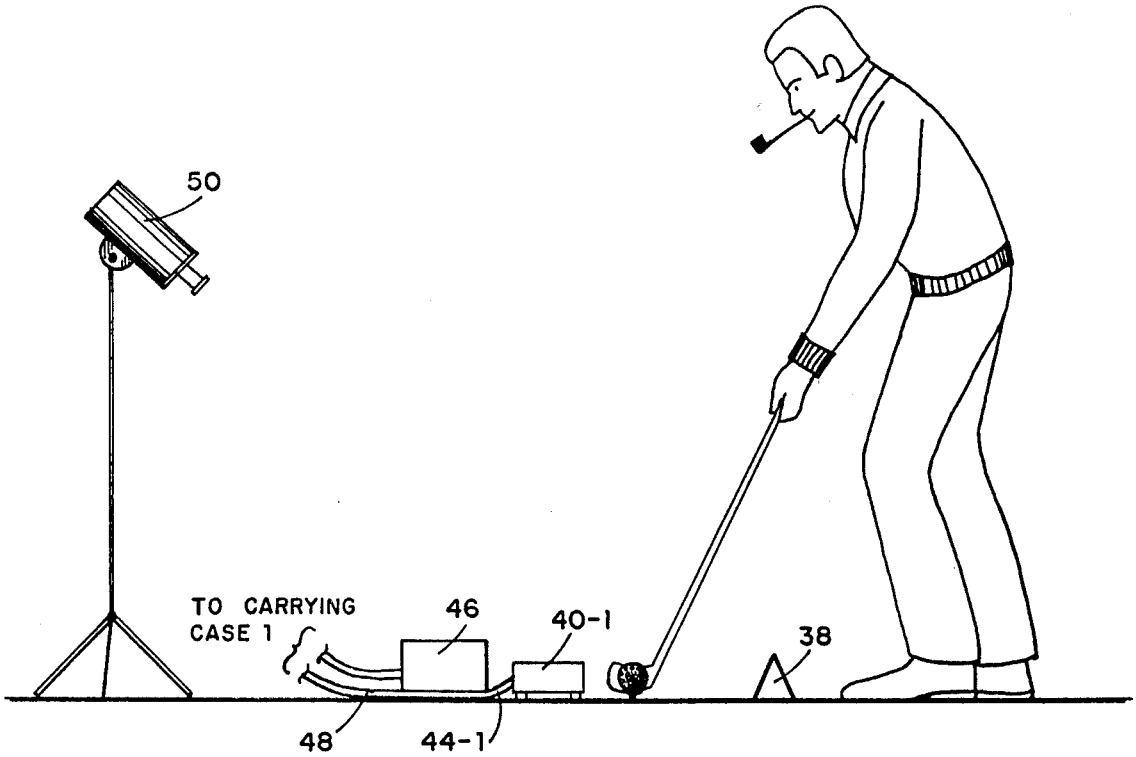
FIG. 5 shows a side view of the present golf training and practice device being utilized in the remote mode of FIG. 4.
Figure 6A:
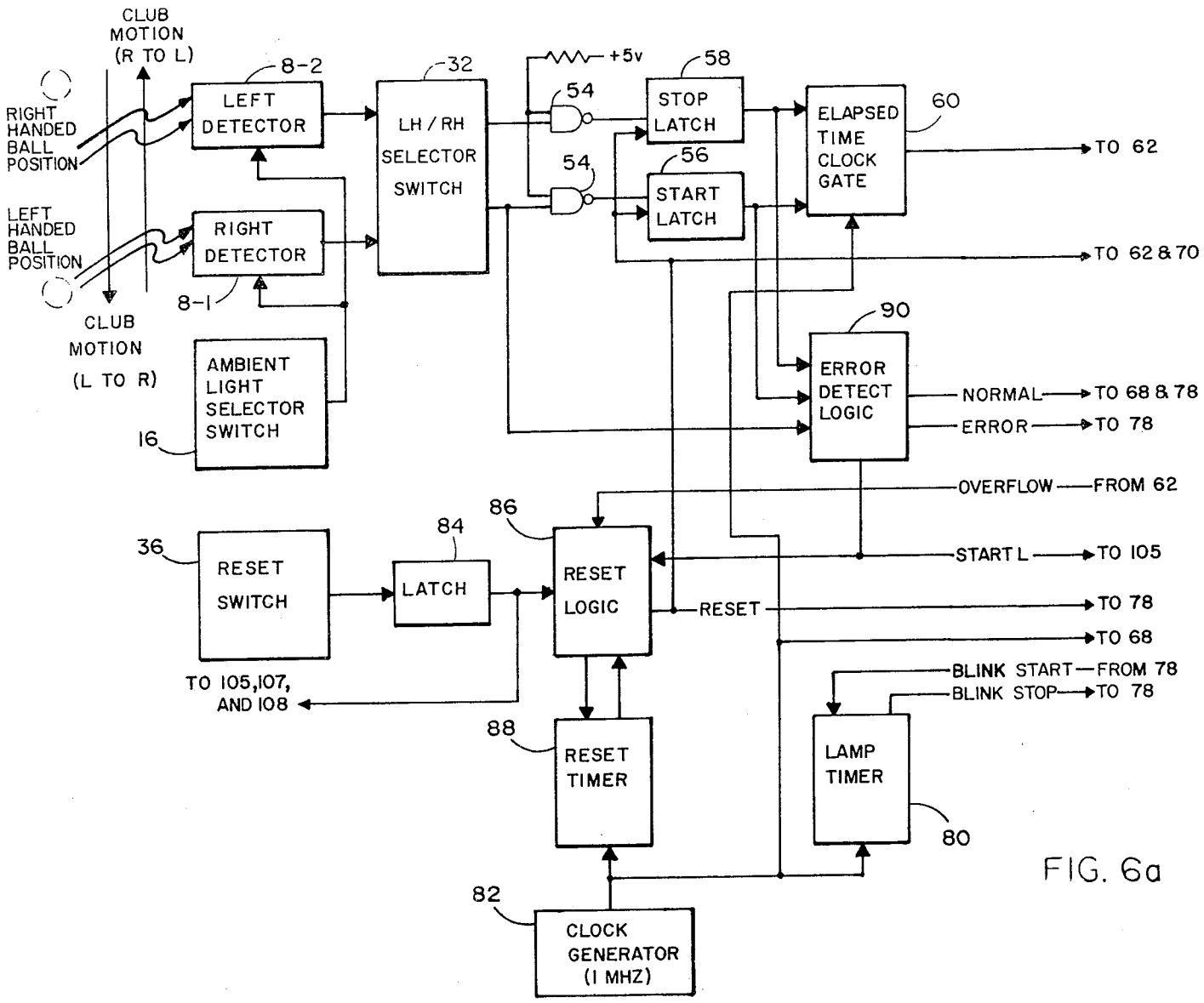
FIGS. 6*a* and 6*b* are block diagrams of an electronic circuit for implementing the present golf training and practice device.
Figure 6B:
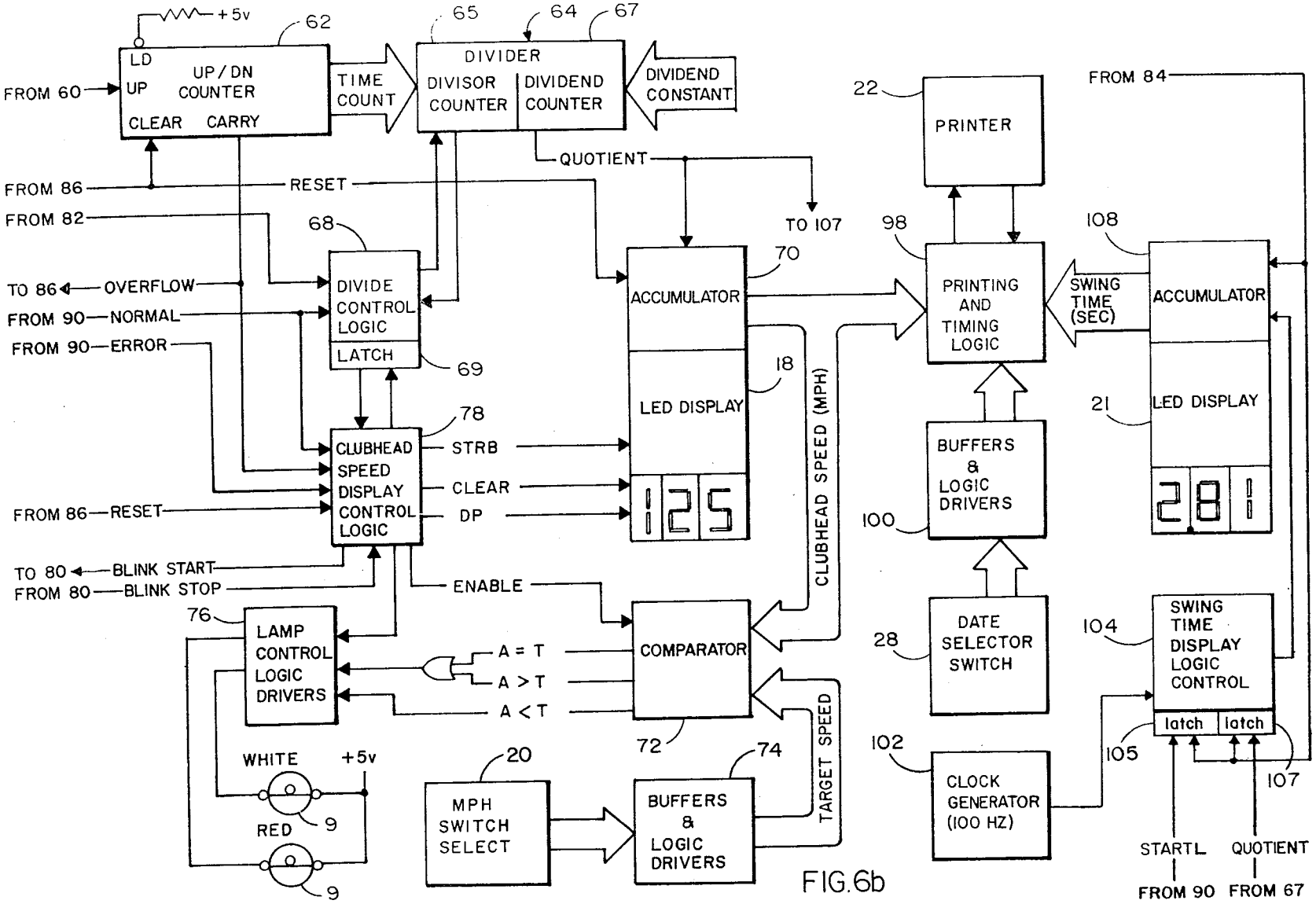

In another embodiment of the invention, the golf training and practice device which comprises the present invention is also adapted to be interfaced and used with either one or all of a remote detector block, a remote digital display, or a remote recording unit. Such a remote or external application is particularly advantageous when it is desirable to concurrently record (e.g. on video tape) the golfer's performance as well as his clubhead speed and swing time, as may be indicated at a remote display (to be described hereinafter). The operation of the present golf training and practice device in a remote or external application is best described while referring to FIGS. 4 and 5 of the drawings. The present training and practice device may have associated therewith an optional, external detector block 40-1, whereby to permit a golfer to practice his swing at a remote location from carrying case 1. Detector block 40-1 is electrically connected to the control panel 12 of carrying case 1 by means of an elongated flexible cable 44-1, which cable includes a conventional jack to facilitate plug-in connection thereof at carrying case 1. In order to activate detector block 40-1 for operation in a remote or external mode, toggle switch 34 (at control panel 12 of FIG. 2) is moved to a suitable position that corresponds with such external operation. When the external detector block 40-1 of FIGS. 4 and 5 is used during a remote mode of operation, the internal detector block 40 of FIGS. 1 and 3 is deactivated (i.e. by the aforementioned toggle switch 34).

Also associated with the present training and practice device is an optional, external digital display unit 46 which is capable of displaying both the golfer's clubhead speed and swing time. Display unit 46 is electrically connected to the carrying case 1 by means of an elongated flexible cable 48, which cable includes a conventional jack to facilitate plug-in connection thereof at carrying case 1. During the remote mode of operation, a pair of displays (not shown) of external display unit 46 are respectively connected in electrical parallel with the internal displays (designated 18 and 21 in FIG. 2), so that each of the golfer's clubhead speed and swing time can be simultaneously displayed to the golfer and to a camera 50 which may also be photographically recording the golfer's performance.

The operation of the golf training or practice device in the remote or external embodiment is the same as that previously described during internal or fixed operation when referring to FIG. 3. That is, external detector block 40-1 includes a pair of photodetectors 8', the optical axes of which establish a measuring zone therebetween. The golfer assumes an appropriate stance behind light stabilizer block 38 and places a golf or practice ball upon a tee at the left or right-handed ball position adjacent the measuring zone. The golfer swings his club through the measuring zone, whereby to break parallel and horizontal beams of ambient light that are supplied from stabilizer block 38 to photodetectors 8'. Accordingly, digital indications of the golfer's clubhead speed and swing time are simultaneously displayed at the remote display unit 46 and at the control panel 12 of carrying case 1. However, and by virtue of the external detector and digital display 40-1 and 46, the golfer is able to practice his golf swing at a remote location from the carrying case 1. What is more, a camera 50 may also be utilized during remote operation, so that the golfer can assemble and maintain a video record of his overall performance.

FIGS. *6a* and *6b* of the drawings illustrate a block diagram for an electronic circuit by which to implement the presently disclosed golf swing training and practice device. As was previously disclosed when referring to the control panel 12 of FIG. 2, the present device is provided with a pair of parallel aligned photodetectors 8-1 and 8-2 that are mounted within a detector head 40 and adapted to be responsive to horizontal beams of ambient light. By way of example, each photodetector 8-1 and 8-2 is a conventional phototransistor, such as part No. MRD300, manufactured by Motorola Corporation. In order to be capable of providing an indication of the golfer's swing time, the left and right-handed ball positions are located outside the boundaries of the measuring zone as established by photodetectors 8-1 and 8-2, respectively. Selector switch 32 is manually adjusted at control panel 12 so as to establish, depending upon the golfer's left or right-handed swing, the order of activation of photodetectors 8-1 and 8-2. By way of example, for a right-handed golfer, photodetector 8-1 will normally be activated before photodetector 8-2. For a left-handed golfer, the position of selector switch 32 is correspondingly changed, so that photodetector 8-2 will normally be activated before photodetector 8-1. Ambient light setting switch 16 at control panel 12 is also appropriately positioned in order to adjust the sensitivity of photodetectors 8-1 and 8-2 and thereby compensate for the varying intensity of light at the environment within which the present training and practice device is to be utilized.

Left and right-handed output terminals of selector switch 32 are connected via buffer gates 54 to respective start or stop latches 56 and 58. By way of example, each of the start and stop latches 56 and 58 may comprise one quarter of a conventional LS279 chip. The start latch is caused to latch whenever a golfer's club is moved into the measuring zone (as defined by the distance between photodetectors 8-1 and 8-2 and best illustrated in FIGS. 3 and 4) and past the first of the pair of photodetectors 8-1. The output of each of the start and stop latches 56 and 58 is interfaced with an elapsed time clock gate 60. The elapsed time clock gate 60 is connected to an up/down counter 62, so as to supply clock pulses thereto and thereby cause counter 62 to count the time which elapses until the golfer's club is moved out of the measuring zone and past the second of the pair of photodetectors 8-2. By way of example, up/down counter 62 is a 16-bit counter comprising four conventional L193 chips cascaded together. At the time that the golfer's club is moved past the second photodetector 8-2, stop latch 58 is latched, whereupon elapsed time clock gate 60 causes counter 62 to terminate its count. By way of example only, up/down counter 62 has a capacity to count for 65 milliseconds before an overflow condition is experienced. An overflow condition occurs when only the first of the pair of photodetectors 8-1 is activated, whereby stop latch 58 fails to latch within a prescribed time (i.e. 65 milliseconds). That is, an overflow will occur in the event that a golfer addresses his practice ball so that his club inadvertently enters the measuring zone but either fails to exit the measuring zone (within 65 milliseconds) or is withdrawn from the measuring zone, such as during a back swing or other preparatory motion.

The count detected by up/down counter 62 is transferred to a divider 64. Divider 64 converts inches per second into miles per hour, so that the golfer can be provided with an accurate indication of his clubhead speed, depending upon both the particular length of the measuring zone (which, for example, in the present embodiment is selected to be 3.0 inches) and the time which elapses before the golfer can swing his club past the photodetectors 8-1 and 8-2 and through the measuring zone therebetween. Typically, divider 64 comprises a pair of up/down counters 65 and 67 that are interconnected with one another. The time counted by up/down counter 62 is loaded into a first of the up/down counters 65 of divider 64. The first counter 65 establishes the divisor of a fraction for converting inches per second into miles per hour. By way of example, counter 65 is a 16-bit counter comprising four conventional L191 chips cascaded together. The second of the up/down counters 67 of divider 64 establishes the dividend of the fraction for converting inches per second into miles per hour. By way of example, counter 67 is a 20-bit counter comprising five conventional L191 chips cascaded together. A binary constant is loaded (e.g. hard wired) into counter 67 to represent the fixed spacing between photodetectors 8-1 and 8-2.

Divider 64 performs the operation of division by the well-known technique of division by subtraction, whereby to obtain an output signal or quotient that is indicative of the speed of the golfer's swing, in miles per hour, through the measuring zone. That is, the up/down counters 65 and 67 of divider 64 are simultaneously decremented (i.e. counted down). When up/down counter 65, which is representative of the divisor, is decremented to zero, it is reloaded with the time counted by up/down counter 62. Up/down counter 65 is again decremented (and reloaded) until counter 67 is ultimately decremented to zero. Thus, by determining the number of times up/down counter 65 is successively emptied, a quotient can be provided corresponding to the number of times that the divisor can be divided into the dividend. For convenience, any remainder is discarded. Control of the loading and decrementing of up/down counters 65 and 67 is provided by means of commercially available divide control logic, designated 68.

Accordingly, the resultant quotient may be loaded into and stored within an accumulator 70. Accumulator 70 is an integral part of the LED display 18 that is located at control panel 12 and is best described when referring to FIG. 2. By way of example, accumulator 70 and display 18 comprise three conventional TIL306 chips cascaded together, in order to function as a 12-bit shift register whereby to store and display information. Moreover, LED display 18 typically includes three characters, each character comprising seven light emitting diode segments. By virtue of the LED display 8, a digital indication of the golfer's clubhead speed, in miles per hour, can be displayed at control panel 12.

As was previously described, divide control logic 68 is provided to control the respective operations of the counters 65 and 67. Divide control logic 68 typically includes a latch 69 (e.g. one quarter of a conventional LS279 chip) which latches at the termination of the division operation, whereby to supply a suitable output signal to a display control logic means 78 and thereby cause the golfer's actual clubhead speed to be displayed at LED display 18. More particularly, the display control logic 78 includes logic gate (e.g. a conventional LS73 chip) that is adapted to apply a signal (designated STRB) to LED display 18 in order to cause the information stored in accumulator 70 to be displayed by display 18. The display 18 will continue to display the golfer's clubhead speed until said display 18 is reset (to be described in greater detail hereinafter).

As was previously disclosed when referring to FIG. 2, control panel 12 includes a thumbwheel selector switch 20 by which the golfer may manually set a target clubhead speed, in miles per hour, to achieve in one or more practice swings. By way of example, selector switch 20 supplies a 12-bit binary coded decimal signal (that is representative of the golfer's desired speed) to a 12-bit comparator 72 via conventional buffers and logic driver circuitry 74. By way of example, comparator 72 comprises three conventional 93L24DM chips cascaded together. A 12-bit binary coded decimal representation of the golfer's actual clubhead speed, as is stored in accumulator 70, is also supplied to comparator 72, so that the golfer's target clubhead speed can be compared with his actual clubhead speed.

An output signal from comparator 72 is supplied, via suitable control logic and driver circuitry 76, to achievement lights 9, whereby to provide the golfer with information regarding the speed by which the head of his golf club is moved through the measuring zone. More particularly, and as previously described when referring to FIG. 1, a pair of colored achievement lights 9 are preferably located within the detector block 40, so as to provide the golfer with a momentary indication as to whether or not his actual clubhead speed (as stored in accumulator 70) has equaled or surpassed his target clubhead speed (set by selector switch 20). That is, a white achievement light may be energized if the golfer's clubhead speed equals or surpasses his target speed, and a red achievement light may be energized if the golfer's clubhead speed is less than his target speed.

The previously described divide control logic 68 is interconnected with a lamp timer 80 via display control logic 78. Display control logic 78 is adapted to provide a control signal (designated ENABLE) whereby to activate comparator 72 only after accumulator 70 is loaded and information is displayed by LED display 18. A control pulse (designated BLINK START) is also provided from display control logic 78 to activate timer 80 when the latch 69 of divide control logic 68 latches (at the completion of the divide operation). Lamp timer 80 includes a counter, such as, for example, that formed by connecting five conventional L193 chips together in cascade. Timer 80 can be implemented so as to count for any particular interval of time (e.g. for approximately 0.5 seconds), whereby to cause the momentary energization of one of the pair of achievement lights 9. A conventional clock generator 82 supplies (e.g. 1 MHz) clock pulses to lamp timer 80 to control the count thereof. When lamp timer 80 times out (i.e. after 0.5 seconds), a control pulse (designated BLINK STOP) is applied, via display control logic 78 and lamp control logic 76, whereby to de-energize achievement lights 9. Clock generator 82 also supplies clock pulses to elapsed time clock gate 60 to control the count thereof.

The reset circuitry of the present training and practice device is now disclosed. As was previously described when referring to FIG. 2, control panel 21 includes a push-button reset switch 36. The manual depression of reset switch 36 causes a latch 84 to latch and thereby generate a control pulse for application to conventional reset logic 86. Accordingly, reset logic 86 is adapted to supply a corresponding output signal (designated RESET) to display control logic 78, whereby to clear the LED display 18. The RESET signal is also supplied from reset logic 86 to each of the start and stop latches 56 and 58, up/down counter 62, and accumulator 70 in order to either reset or clear and, thereby, adapt each of the aforementioned components to be responsive to new information regarding a subsequent swing of the golfer's clubhead through the measuring zone. Thus, reset switch 36 and reset logic 86 provide a means by which to manually condition the circuitry of the present device to display a golfer's clubhead speed during successive practice swings.

The present training and practice device also includes means by which to automatically reset the circuitry thereof, so as to be capable of providing information regarding the speed of a subsequent golf swing. More particularly, a reset timer 88 is interconnected between clock generator 82 and reset logic 86. Reset timer 88 includes a timer, such as, for example, that formed by connecting five conventional L193 chips together in cascade. Timer 88 can be implemented so as to count for any particular interval of time (e.g. approximately 1.0 seconds). Clock generator 82 supplies clock pulses to reset timer 88 to control the count thereof. When the reset timer times out (i.e. after one second), a control pulse is applied to reset logic 86, whereby to generate a suitable signal, designated RESET, and thereby automatically cause LED display 18, start and stop latches 56 and 58, counter 62 and accumulator 70 to be either reset or cleared, so as to be responsive to new information regarding a subsequent swing of the golfer's clubhead through the measuring zone.

The present golf training and practice device includes error detection logic 90 which is responsive to the order in which photodetectors 8-1 and 8-2 are activated. Error detection logic 90 includes three logical AND gates (not shown), the input terminals of which are respectively connected to receive input signals from each of the selector switch 32 and start and stop latches 56 and 58. In the event that the golfer swings his club past photodetectors 8-1 and 8-2 and through the measuring zone formed therebetween within a predetermined time (e.g. less than 65 milliseconds), error detection logic 90 is adapted to supply an output signal (designated NORMAL) to each of divide control logic 68 and display control logic 78, whereby to cause the counters 65 and 67 of divider 64 to be loaded with appropriate data, as has been earlier disclosed.

Error detection logic 90 is also responsive to a condition when stop latch 58 is caused to latch prior to the activation of photodetector 8-1. That is, the photodetector 8-2, which denotes the end of the measuring zone for a right-handed golfer, (and the corresponding stop latch 58) may be activated prior to the activation of photodetector 8-1 (and the corresponding start latch 56), which denotes the entrance to the right-handed measuring zone. This sequence of photodetector operation is likely to occur when a right-handed golfer places his club in front of photodetector 8-2 while addressing his ball as a preparatory step before starting his backswing. Accordingly, the error detection logic 90 is adapted to supply an output signal (designated ERROR), whereby to cause display control logic 78 to generate a signal (designated DP) in order that LED display 18 will display a symbol, such as a decimal point, at each digit thereof. The decimal points will continue to be displayed until either a manual reset is initiated by depressing push-button reset switch 36 or a reset of the circuitry of the training and practice device is automatically accomplished, by means of reset logic 86 and reset timer 88, after approximately a one second time delay, as will be hereinafter disclosed.

As just described, error detection logic 90 supplies an output signal ERROR when stop latch 58 is latched prior to start latch 56. When the golfer's club is eventually moved, at the start of a backswing, past photodetector 8-2, whereby to cause start latch 56 to also latch, error detection logic 90 will supply an output signal, designated STARTL, which is indicative of the fact that start latch 56 has been latched subsequent to stop latch 58. The STARTL output signal from error detection logic 90 is supplied to each of reset logic 86 and to (a latch 105 of) swing time display control logic 104. Upon receipt of the STARTL signal, the reset timer 88 of reset logic 86 begins to count for one second. As described above, when the reset timer 88 times out, reset logic 86 generates a RESET signal to clear the LED display 18 (of decimal points) and conditions the start and stop latches 56 and 58 to be responsive to a downward movement of a golfer's clubhead past photodetectors 8-1 and 8-2 in order that clubhead speed may be measured. As will be disclosed shortly, application of the STARTL signal to swing time display control logic 104 starts a count of the total time needed for the golfer to complete a swing of his golf club (i.e. from adjacent the right or left-handed ball position at the start of the backswing until an impact is made with the ball at the end of the downswing).

An output terminal of up/down counter 62 is connected to reset logic 86, so as to supply an output signal (designated OVERFLOW) thereto. In the event that counter 62 should experience an overflow condition, because of a failure of a golfer's club to pass between photodetectors 8-1 and 8-2 in the prescribed time (e.g. less than 65 milliseconds), an OVERFLOW signal is generated. Accordingly, reset logic 86 will be activated so as to supply a RESET signal and thereby automatically reset the circuitry of the present device (as has been hereinabove described) after the reset timer 88 thereof times out.

As was previously disclosed, the total elapsed time in which a golfer completes his swing, from the start of a backswing until impact is made with a golf ball, is displayed, in hundredths of seconds, by digital display 21 (at control panel of FIG. 2). Similar to digital display 18, as disclosed above, digital display 21 is preferably implemented by a series of three characters, each character comprising conventional light emitting diode segments, or the like. The characters or digits of display 21 may be formed by three conventional TIL 306 counter/display chips cascaded together, so that the maximum count of display 21 is 9.99 seconds. Display 21 has an accumulator 108 integrally associated therewith, whereby to form a 12-bit shift register to store and display information regarding the golfer's swing time.

Display 21 is clocked by a 100 Hz clock generator 102. Generator 102 includes a free running oscillator, such as a conventional 9601DM oscillator, operating at a frequency of 800 Hz. Clock generator 102 also includes a plurality of flip-flops, such as one half of three conventional LS73 chips connected together in electrical series, by which to successively count the clock oscillator frequency down from 800 Hz to 100 Hz (i.e. with a corresponding period of 0.01 seconds).

The 100 Hz clock output signal produced by clock generator 102 is supplied to an input terminal of swing time display control logic 104. Display control logic 104 includes signal gating means, such as a three-input logical NAND gate (not shown), by which to gate the output state of clock generator 102 to repetitive on and off conditions. By way of example, the NAND gate of display control logic 104 may be implemented by one third of a conventional L10 chip, one input terminal of which is connected to receive the aforementioned 100 Hz clock signal from clock generator 102. Swing time display control logic 104 also includes a pair of start/-stop latches 105 and 107, the output terminals of which are respectively connected to second and third input terminals of the display control logic NAND gate. Each of latches 105 and 107 may be implemented by one quarter of a conventional LS279 chip. The output terminal of the NAND gate of swing time display control logic 104 is connected to an input terminal of LED display accumulator 108, so that an indication of the golfer's elapsed swing time, in seconds, may be displayed by LED display 21.

The golfer's swing time is measured or counted and stored in accumulator 108 when start/stop latch 105 of swing time display control logic 104 is set by means of the STARTL signal which is supplied thereto from error detection logic 90. As previously disclosed, the STARTL signal is supplied to latch 105 at the beginning of the golfer's backswing, after the golfer moves his club away from the right or left-handed ball position and past photodetectors 8-1 and 8-2 (so that latches 56 and 58 are latched in a sequence which is indicative of a backswing. The measurement of the golfer's swing time is terminated when an output signal, designated QUOTIENT, is supplied from counter 67 to swing time display control logic 104, so as to set start/stop latch 107. As previously disclosed, a QUOTIENT signal is generated during normal operation of the present golf swing training and practice device, when the golfer's clubhead speed has been computed (i.e. after the golfer's clubhead has traversed in a downward direction the measuring zone established by photodetectors 8-1 and 8-2). When start/stop latch 107 is set (by means of the aforementioned QUOTIENT signal), information that is stored in accumulator 108 and related to the golfer's elapsed swing time is displayed by LED display 21. Accordingly, the golfer is provided with a means by which to accurately monitor his swing time so as to be able to easily compare and correlate his elapsed swing time (at display 21) with his clubhead speed (at display 18).

Reset of digital display 21 is accomplished by means of the previously described manual reset push-button switch 36 (at control panel 12 of FIG. 2). That is, by depressing reset switch 36, a suitable signal is applied from the output terminal of latch 84, whereby to reset each of the start/stop latches 105 and 106, empty the contents of accumulator 108, and clear the LED display 21. The present practice and training device is, therefore, ready to respond to new information regarding a golfer's swing time (and clubhead speed) during a subsequent golf club swing. However, it is to be understood that the LED display 21 is cleared only by depressing manual reset switch 36. Unlike display 18, display 21 will not be automatically cleared after a one second time delay (as is accomplished for display 18 by means of reset logic 86 and reset timer 88), so that a calculation and display of the golfer's swing time will not be prematurely interrupted.

As was previously disclosed when referring to FIG. 2, control panel 21 has a printer 22 located thereat which is adapted to provide a permanent record of the golfer's clubhead speed and elapsed swing time. Printer 22 is interfaced with conventional printing and timing logic 98, so that the information stored within accumulators 70 and 108 (and displayed by LED displays 18 and 21) can be printed on a paper tape, or the like. What is more, control panel 21 is also provided with a thumbwheel date selector switch 28 by which the golfer can (by manually depressing a push-button switch 30) cause the date of each practice swing to be recorded upon the paper tape of printer 22. Therefore, selector switch 28 is interfaced with conventional buffers and drive circuitry 100, so as to provide a 24-bit binary coded decimal signal (that is indicative of the month, day and year) thereto. The binary coded decimal signal is supplied to printer 22 via printing and timing logic 98, so that printer 22 will be responsive to any change of date as established at selector switch 28.

It will be apparent that while a preferred embodiment of the invention has been shown and described, various modifications and changes may be made without departing from the true spirit and scope of the invention. For example, reference voltages may be required by some of the electrical components (e.g. up/down counter 62) that have been described above. Therefore, the present device may include an internal voltage regulator circuit to suitably reduce the battery voltage to approximately 5.0 volts DC.

Having thus set forth a preferred embodiment of the instant invention, what is claimed is:

1. A golf swing practice device including means for measuring the speed at which a golfer swings his club through a measuring zone, said practice device comprising:

at least two optical detectors, the respective optical axes of which defining opposite ends of the measuring zone, the first of said optical detectors being activated when the golfer's club enters the measuring zone and the second of the optical detectors being activated when the golfer's club exits the measuring zone, means by which to supply said optical detectors with respective beams of light, computational means interfaced with said optical detectors to measure the elapsed time between the respective activations thereof, said computational means being adapted to provide an indication of the speed at which the golfer swings his club through the measuring zone depending upon said elapsed time and distance between the optical axes of said detectors, display means interfaced with said computational means for displaying the indication of the measured speed at which the golfer swings his club through the measuring zone, switch means interfaced with said computational means by which a golfer can select a particular speed to achieve when swinging his club through the measuring zone, and comparator means by which to compare the golfer's selected club speed with his measured club speed, so that an indication can be provided by which to inform the golfer as to whether or not his measured club speed has surpassed his selected club speed.

2. The golf swing practice device recited in claim 1, further comprising a detector block, said detector block having a pair of spaced apertures formed therein for respectively receiving therewithin the optical detectors and for arranging said optical detectors so that the optical axes thereof are in parallel alignment with respect to one another.

3. The golf swing practice device recited in claim 2, wherein the lengths of said apertures are at least twelve times larger than the diameters thereof, so that the optical detectors positioned therewithin are aligned to receive substantially parallel and horizontal beams of ambient light.

4. The golf swing practice device recited in claim 2, wherein said detector block is electrically interconnected with said computational means by means of an elongated electrical cable, so as to thereby permit said detector block and computational means to be separated from one another.

5. The golf swing practice device recited in claim 1, wherein said display means is a digital display for displaying, in miles per hour, the measured speed at which the golfer swings his club through the measuring zone.

6. The golf swing practice device recited in claim 1, wherein said display means is electrically interconnected with said computational means by means of an elongated electrical cable, so as to thereby permit said display means and computational means to be separated from one another.

7. The golf swing practice device recited in claim 1, further comprising indicator lamp means interfaced with said computational means and adapted to provide a visual indication as to whether or not the golfer's measured club speed has surpassed his selected club speed.

8. The golf swing practice device recited in claim 1, further comprising printer means interfaced with said computational means and adapted to provide a printed indication of the measured speed at which the golfer swings his club through the measuring zone.

9. The golf swing practice device recited in claim 8, further comprising selector switch means by which to set the date on which the golfer takes a practice swing, said selector switch means being interfaced with said printer means so that the measured speed at which the golfer swings his club through the measuring zone and the date of said swing can be printed.

10. The golf swing practice device recited in claim 1, further comprising reset switch means interconnected with said optical detectors, said computational means, and said display means, the manual actuation of said reset switch means acting to deactivate said optical detectors, clear said computational means of the indication of said measured club speed, and blank said display means.

11. The golf swing practice device recited in claim 1, further comprising timing and reset means, said timing means being interfaced with the first optical detector at the entrance of said measuring zone, said timing means being activated when said first optical detector is activated, said reset means interconnected with said first optical detector and being activated by said timing means in the event that the second of said optical detectors at the exit of said measuring zone is not activated within a particular predetermined time, whereby to deactivate said first optical detector.

12. The golf swing practice device recited in claim 1, further comprising light reflector means being aligned with and spaced from said optical detectors, so as to supply to each of said detectors horizontal beams of ambient light, which beams have substantially identical intensities.

13. The golf swing practice device recited in claim 1, further comprising means interconnected with said optical detectors by which to adjust the sensitivity thereof to account for changes in the intensity of the ambient light beams that are supplied to said detectors.

14. The golf swing practice device recited in claim 1, further comprising:

golf club direction detection means interfaced with said optical detectors and responsive to the order of activation thereof, said direction detection means supplying an output signal when said optical detectors are activated in a particular order that is indicative of a backswing of the golfer's club through the measuring zone, additional computational means connected to receive the output signal from said direction detection means in order to initiate a measurement of the elapsed time of the golfer's swing from the backswing through the measuring zone until a downswing through the measuring zone, and additional display means interfaced with said additional computational means for displaying the measurement of the elapsed time of the golfer's golf club swing.

15. The golf swing practice device recited in claim 1, wherein said optical detectors are supplied with substantially horizontal and parallel aligned beams of ambient light.

16. A golf swing practice device including means for measuring the speed at which a golfer swings his golf club, said device comprising:

a first optical detector to receive a first beam of light, a second optical detector to receive a second beam of light, said first and second optical detectors supplying respective output signals in a particular order when the golfer's club is swung in front thereof during a downswing so as to interrupt the receipt of the first and second beams of light, first timer means interfaced with said first and second optical detectors and adapted to measure the time between the generation of the respective output signals therefrom, second timer means also interfaced with said first and second optical detectors and adapted to measure the total elapsed swingtime including a sum of the time to complete the backswing past one of said detectors so as to interrupt a first of said beams of light and the time to complete the downswing past each of said detectors so as to interrupt the first and second of said beams of light, and computational means interfaced with said first timer means to provide an indication of the speed at which the golfer swings his club past said optical detectors, said indication being dependent upon said measured time and the distance between said first and second optical detectors.

17. The device recited in claim 16, wherein said first and second beams of light are substantially horizontal and parallel aligned ambient light beams.

18. The device recited in claim 16, further comprising:

error detection means interfaced with said first and second optical detectors and responsive to the order in which respective output signals are supplied therefrom, said error detection means supplying an output signal to actuate said second timer means when the order in which the output signals are supplied from said optical detectors is indicative of a backswing of the golfer's club therepast, and display means interfaced with each of said computational means and said second timer means for displaying both the indication of speed at which the golfer swings his club downwardly past said optical detectors and the measurement of the elapsed time to complete the golfer's swing.

19. The device recited in claim 18, wherein said display means is remotely located with respect to said optical detectors and said computational means.

* * * * *